US009847069B2

(12) United States Patent
Zhao

(10) Patent No.: US 9,847,069 B2
(45) Date of Patent: Dec. 19, 2017

(54) GOA CIRCUIT AND LIQUID CRYSTAL DISPLAY DEVICE

(71) Applicant: Wuhan China Star Optoelectronics Technology Co., Ltd., Wuhan (CN)

(72) Inventor: Mang Zhao, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 137 days.

(21) Appl. No.: 14/917,571

(22) PCT Filed: Jan. 29, 2016

(86) PCT No.: PCT/CN2016/072849
§ 371 (c)(1),
(2) Date: Mar. 8, 2016

(87) PCT Pub. No.: WO2017/107294
PCT Pub. Date: Jun. 29, 2017

(65) Prior Publication Data

US 2017/0301302 A1 Oct. 19, 2017

(30) Foreign Application Priority Data

Dec. 23, 2015 (CN) ..... 2015 1 0980037

(51) Int. Cl.
*G09G 3/34* (2006.01)
*G09G 3/36* (2006.01)

(52) U.S. Cl.
CPC ... *G09G 3/3677* (2013.01); *G09G 2310/0289* (2013.01); *G09G 2310/08* (2013.01)

(58) Field of Classification Search
CPC ..... G09G 2310/0286; G09G 2310/08; G09G 2300/0871; G09G 2310/0267; G09G 3/3674; G09G 2310/0289; G09G 2310/0291; G09G 2310/06; G09G 3/3266; G09G 2310/0205; G11C 19/28; G11C 19/184; G11C 19/287; G11C 19/00
USPC ..... 345/98–100
See application file for complete search history.

(56) References Cited

U.S. PATENT DOCUMENTS

2014/0169518 A1* 6/2014 Kong ..... G09G 3/3674 377/64
2014/0176410 A1* 6/2014 Ma ..... G09G 3/3622 345/92
2016/0343323 A1* 11/2016 Xiao ..... G09G 3/3648

* cited by examiner

*Primary Examiner* — Duc Dinh
(74) *Attorney, Agent, or Firm* — Leong C. Lei

(57) ABSTRACT

The present invention provides a GOA circuit and a liquid crystal display device. The GOA circuit adds the stage transfer unit (900) and the stage transfer pull-down unit (800) and modifying the global control auxiliary unit (1000) to use the stage transfer end (ST(N)) of the stage transfer unit (900) to output the signal which is different from the scan driving signal to be the stage transfer signal and to use the global control auxiliary unit (1000) to stable the voltage level of the stage transfer end (ST(N)) in the period that the output ends (G(N)) of all the GOA units output the scan driving signal at the same time, the signal outputted by the stage transfer end (ST(N)) is opposite to the voltage level of the scan driving signal.

16 Claims, 9 Drawing Sheets

GOA CIRCUIT AND LIQUID CRYSTAL DISPLAY DEVICE

FIELD OF THE INVENTION

The present invention relates to a display technology field, and more particularly to a GOA circuit and a liquid crystal display device.

BACKGROUND OF THE INVENTION

The Liquid Crystal Display (LCD) possesses advantages of thin body, power saving and no radiation to be widely used in many application scope, such as LCD TV, mobile phone, personal digital assistant (PDA), digital camera, notebook, laptop, and dominates the flat panel display field.

The GOA technology, i.e. the Gate Driver on Array technology utilizes the original array manufacture processes of the liquid crystal display panel to manufacture the driving circuit of the level scan lines on the substrate around the active area, to replace the external Integrated Circuit (IC) for accomplishing the driving of the level scan lines. The GOA technology can reduce the bonding procedure of the external IC and has potential to raise the productivity and lower the production cost. Meanwhile, it can make the liquid crystal display panel more suitable to the narrow frame or non frame design of display products.

With the development of the LTPS semiconductor TFT, the LTPS-TFT LCD also becomes the focus that people pay lots of attentions. The LTPS-TFT LCD possesses advantages of high resolution, fast response speed, high brightness and high aperture ratio. Because the LTPS semiconductor has better order than amorphous silicon (a-Si) and the LTPS itself has extremely high carrier mobility which can be more than 100 times of the amorphous silicon semiconductor, which the GOA skill can be utilized to manufacture the gate driver on the TFT array substrate to achieve the objective of system integration and saving the space and the cost of the driving IC.

FIG. 1 shows a GOA circuit employed in the LTPS liquid crystal display device according to prior art, comprising GOA units of a plurality of stages. The GOA circuit of prior art does not only possess the fundamental scan driving function and the shift register function, but also the function of outputting the scan driving signals for all the respective stages at the same time (All Gate On). The GOA unit of each stage comprises: a control input unit 100, a voltage stabilizing unit 200, an output control unit 300, a second node control unit 400, a first node pull-down unit 500, a pull-down holding unit 600, a global control unit 700 and a global control auxiliary unit 800.

N is set to be a positive integer and except the GOA unit of the first and second stages, in the GOA unit of the Nth stage:

the control input unit 100 comprises: a first thin film transistor T1, and a gate of the first thin film transistor T1 is electrically coupled to a M+2th clock signal CK(M+2), and a source is electrically coupled to a stage transfer end G(N−2) of two former stage N−2th GOA unit, and a drain is electrically coupled to a third node K(N); a scan driving signal of the N−2th GOA unit outputted by the output end G(N−2) of two former stage N−2th GOA unit is employed to be a stage transfer signal;

the voltage stabilizing unit 200 comprises: a second thin film transistor T2, and a gate of the second thin film transistor T2 is electrically coupled to a constant voltage level VGH, and a source is electrically coupled to the third node K(N), and a drain is electrically coupled to a first node Q(N);

the output unit 300 comprises: a third thin film transistor T3, and a gate of the third thin film transistor T3 is electrically coupled to the first node Q(n), and a source is electrically coupled to a Mth clock signal CK(M), and a drain is electrically coupled to an output end G(n); and a first capacitor C1, and one end of the first capacitor C1 is electrically coupled to a first node Q(n), and the other end is electrically coupled to the output end G(n);

the second node control unit 400 comprises: a fourth thin film transistor T4, and a gate of the fourth thin film transistor T4 is electrically coupled to the third node K(N), and a source is electrically coupled to the M+2th clock signal CK(M+2), and a drain is electrically coupled to the second node P(N); and an eighth thin film transistor T8, and a gate of the eighth thin film transistor T8 is electrically coupled to the M+2th clock signal CK(M+2), and a source is electrically coupled to the constant high voltage level VGH, and a drain is electrically coupled to the second node P(N);

the first node pull-down unit 500 comprises: a sixth thin film transistor T6, and a gate of the sixth thin film transistor T6 is electrically coupled to the Mth clock signal CK(M), and a source is electrically coupled to a drain of a seventh thin film transistor T7, and a drain is electrically coupled to the third node K(N); and the seventh thin film transistor T7, and a gate of the seventh thin film transistor T7 is electrically coupled to the second node P(N), and a source is electrically coupled to a low constant voltage level VGL;

the pull-down holding unit 600 comprises: a fifth thin film transistor T5, and a gate of the fifth thin film transistor T5 is electrically coupled to the second node P(N), and a source is electrically coupled to the low constant voltage level VGL, and a drain is electrically coupled to the output end G(N); and a second capacitor C2, and one end of the second capacitor C2 is electrically coupled to the second node P(N), and the other end is electrically coupled to the low constant voltage level VGL;

the global control unit 700 comprises: a tenth thin film transistor T10, and both a gate and a source of the tenth thin film transistor T10 are electrically coupled to a global control signal Gas, and a drain is electrically coupled to the output end G(N); and a ninth thin film transistor T9, and a gate of the ninth thin film transistor T9 is electrically coupled to the global control signal Gas, and a source is electrically coupled to the constant low voltage level VGL, and a drain is electrically coupled to the second node P(N);

the global control auxiliary unit 800 comprises: an eleventh thin film transistor T11, and a gate of the eleventh thin film transistor T11 is electrically coupled to a global control signal Gas, and a source is electrically coupled to the constant low voltage level VGL, and a drain is electrically coupled to the third node K(N).

With combination of FIG. 2, FIG. 1 shows that the working procedure of the GOA circuit according to prior art mainly comprises two parts: one part is that the global control signal Gas controls the output ends of all the GOA units to output high voltage levels at the same time, and the other part is that after the All Gate On function is accomplished, driving the GOA units of the respective stages is performed. There is an inevitable risk existing in the GOA circuit of prior art. The existence of the risk can directly lead to the failure of the entire circuit: with the existence of the first capacitor C1 at the output end G(N), after the global control signal Gas provides high voltage level, and the All Gate On function is accomplished, the output ends G(N) of all the GOA units will be constantly kept to be the high voltage level of the global control signal Gas. If the high voltage level of the output end G(N) cannot be discharged to be low voltage level before the high voltage level of the Mth clock signal comes, the normal work of the GOA circuit will be influenced.

The first stage GOA unit and the third stage GOA unit which are cascade coupled are illustrated for explanation: both the source of the third thin film transistor T3 in the first stage GOA unit and the gate of the first thin film transistor T1 in the third stage GOA unit are electrically coupled to the first clock signal CK(1), and both the source of the third thin film transistor T3 in the third stage GOA unit and the gate of the first thin film transistor T1 in the first stage GOA unit are electrically coupled to the third clock signal CK(3). Because the stage transfer signal of the first stage GOA unit is STV, the driving of the first stage GOA unit is normal (the normal work starts from the first pulse generated by the third clock signal CK(3)), and no redundant pulse signal is generated. The stage transfer signal inputted to the third stage GOA unit is the scan driving signal outputted by the output end G(1) of the first stage GOA unit, and the scan driving signal outputted by the output end G(1) of the first stage GOA unit can influence the working state of the third stage GOA unit. Because after accomplishing global controlling the output ends of all the GOA units to output high voltage levels at the same time, the output end G(1) of the first stage GOA unit is kept to be high voltage level with the first capacitor C1. Then, the first thin film transistor T1 in the third stage GOA unit is controlled by the first clock signal CK(1). When the first high voltage level of the first clock signal CK(1) comes, the high voltage level of the output end G(1) of the first stage GOA unit is transmitted to the first node Q(3) of the third stage GOA unit, which leads to that the third stage GOA unit acts before the first stage GOA unit works, and the output end G(3) of the third stage GOA unit generates one redundant pulse. This redundant pulse will be always stage transferred forward along with the outputted scan driving signal, and thus to influence the scan driving signal of the next stage. Moreover, all the GOA stages of which the inputs are controlled by the first clock signal CK(1), i.e. the output ends G(3), G(7), G(11) of the GOA units of which the gates of the first thin film transistors T1 are electrically coupled to the first clock signal CK(1) will generate the redundant pulse signals, which ultimately result in the failure of the entire GOA circuit.

SUMMARY OF THE INVENTION

An objective of the present invention is to provide a GOA circuit that under the premise of preserving the function of global controlling the output ends of all the GOA units to output at the same time, the circuit failure issue due to that the scan driving signal outputted by the GOA unit is employed to be the stage transfer signal in prior art can be avoided to eliminate the redundant pulse in the GOA circuit stage transferring procedure for ensuring the normal work of the GOA circuit and promoting the working stability of the liquid crystal display device.

Another objective of the present invention is to provide a liquid crystal display device possessing well working stability.

For realizing the aforesaid objectives, the present invention provides a GOA circuit, comprising GOA units of a plurality of stages which are cascade coupled, and the GOA unit of each stage comprises: a control input unit, a voltage stabilizing unit, an output unit, a second node control unit, a first node pull-down unit, a pull-down holding unit, a global control unit, a stage transfer pull-down unit, a stage transfer unit and a global control auxiliary unit;

N is set to be a positive integer and except the GOA unit of the first and second stages, in the GOA unit of the Nth stage:

the control input unit comprises: a first thin film transistor, and a gate of the first thin film transistor is electrically coupled to a M+2th clock signal, and a source is electrically coupled to a stage transfer end of two former stage n−2th GOA unit, and a drain is electrically coupled to a third node;

the voltage stabilizing unit comprises: a second thin film transistor, and a gate of the second thin film transistor is electrically coupled to a first constant voltage level, and a source is electrically coupled to the third node, and a drain is electrically coupled to a first node;

the output unit comprises: a third thin film transistor, and a gate of the third thin film transistor is electrically coupled to the first node, and a source is electrically coupled to a Mth clock signal, and a drain is electrically coupled to an output end; and a first capacitor, and one end of the first capacitor is electrically coupled to the first node, and the other end is electrically coupled to the output end;

the second node control unit comprises: a fourth thin film transistor, and a gate of the fourth thin film transistor is electrically coupled to the third node, and a source is electrically coupled to the M+2th clock signal, and a drain is electrically coupled to the second node; and an eighth thin film transistor, and a gate of the eighth thin film transistor is electrically coupled to the M+2th clock signal, and a source is electrically coupled to the first constant voltage level, and a drain is electrically coupled to the second node;

the first node pull-down unit comprises: a sixth thin film transistor, and a gate of the sixth thin film transistor is electrically coupled to the Mth clock signal, and a source is electrically coupled to a drain of a seventh thin film transistor, and a drain is electrically coupled to the third node; and the seventh thin film transistor, and a gate of the seventh thin film transistor is electrically coupled to the second node, and a source is electrically coupled to a second constant voltage level;

the pull-down holding unit comprises: a fifth thin film transistor, and a gate of the fifth thin film transistor is electrically coupled to the second node, and a source is electrically coupled to the second constant voltage level, and a drain is electrically coupled to the output end; and a second capacitor, and one end of the second capacitor is electrically coupled to the second node, and the other end is electrically coupled to the second constant voltage level;

the global control unit comprises: an eleventh thin film transistor, and a gate of the eleventh thin film transistor is electrically coupled to a global control signal, and a source is electrically coupled to the second constant voltage level, and a drain is electrically coupled to the second node; and a twelfth thin film transistor, and both a gate and a source of the twelfth thin film transistor are electrically coupled to the global control signal, and a drain is electrically coupled to the output end;

the stage transfer pull-down unit comprises: a tenth thin film transistor, and a gate of the tenth thin film transistor is electrically coupled to the second node, and a source is electrically coupled to the second constant voltage level, and a drain is electrically coupled to the stage transfer end;

the stage transfer comprises: a ninth thin film transistor, and a gate of the ninth thin film transistor is electrically coupled to the first node, and a source is electrically coupled to the Mth clock signal, and a drain is electrically coupled to the stage transfer end;

the global control auxiliary unit comprises: a thirteenth thin film transistor, and a gate of the thirteenth thin film transistor is electrically coupled to the output end, and a source is electrically coupled to a drain of a fourteenth thin film transistor, and a drain is electrically coupled to the stage transfer end; and the fourteenth thin film transistor, and a gate of the fourteenth thin film transistor is electrically coupled to the global control signal, and a source is electrically coupled to the second constant voltage level.

Selectably, the respective thin film transistors are all N-type LTPS semiconductor thin film transistors, and the first constant voltage level is a constant high voltage level, and the second constant voltage level is a constant low voltage level.

Selectably, as the global control signal provides high voltage level, the output ends of all the GOA units output high voltage levels at the same time, and meanwhile, the stage transfer ends of all the GOA units output low voltage levels at the same time.

Selectably, the respective thin film transistors are all P-type LTPS semiconductor thin film transistors, and the first constant voltage level is a constant low voltage level, and the second constant voltage level is a constant high voltage level.

Selectably, as the global control signal provides low voltage level, the output ends of all the GOA units output low voltage levels at the same time, and meanwhile, the stage transfer ends of all the GOA units output high voltage levels at the same time.

Selectably, in the first stage GOA unit and the second stage GOA unit, the source of the first thin film transistor T1 is electrically coupled to a start signal STV of the circuit.

The GOA circuit comprises four clock signals: a first, a second, a third and a fourth clock signals; as the Mth clock signal is the third clock signal, the M+2th clock signal is the first clock signal; as the Mth clock signal is the fourth clock signal, the M+2th clock signal is the second clock signal.

The pulse periods of the first, the second, the third and the fourth clock signals are the same, and a first pulse signal of the first clock signal is first generated, and a first pulse signal of the second clock signal is generated at the same time while the first pulse signal of the first clock signal is finished, and a first pulse signal of the third clock signal is generated at the same time while the first pulse signal of the second clock signal is finished, and a first pulse signal of the fourth clock signal is generated at the same time while the first pulse signal of the third clock signal is finished, and a second pulse signal of the first clock signal is generated at the same time while the first pulse signal of the fourth clock signal is finished.

The present invention further provides a liquid crystal display device, comprising the aforesaid GOA circuit.

The benefits of the present invention are: the present invention provides a GOA circuit. By adding the stage transfer unit and the stage transfer pull-down unit and modifying the global control auxiliary unit to use the stage transfer end of the stage transfer unit to output the signal which is different from the scan driving signal to be the stage transfer signal and to use the global control auxiliary unit to stable the voltage level of the stage transfer end in the period that the output ends of all the GOA units output the scan driving signal at the same time, the signal outputted by the stage transfer end is opposite to the voltage level of the scan driving signal. After accomplishing global controlling the output ends of all the GOA units to output at the same time, the circuit failure issue due to that the scan driving signal outputted by the GOA unit is employed to be the stage transfer signal in prior art can be avoided to eliminate the redundant pulse in the GOA circuit stage transferring procedure for ensuring the normal work of the GOA circuit and promoting the working stability of the liquid crystal display device. The liquid crystal display device of the present invention comprises the aforesaid GOA circuit, and possesses well working stability.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
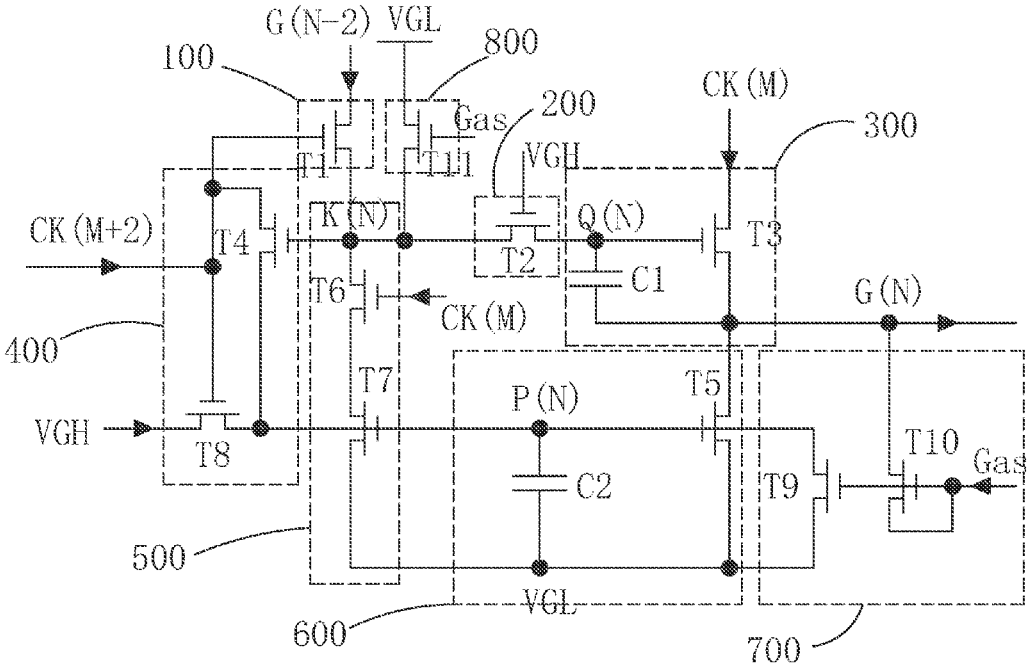
Fig. 1 (Prior Art)
FIG. 1 is a circuit diagram of a GOA circuit according to prior art.
Figure 2:
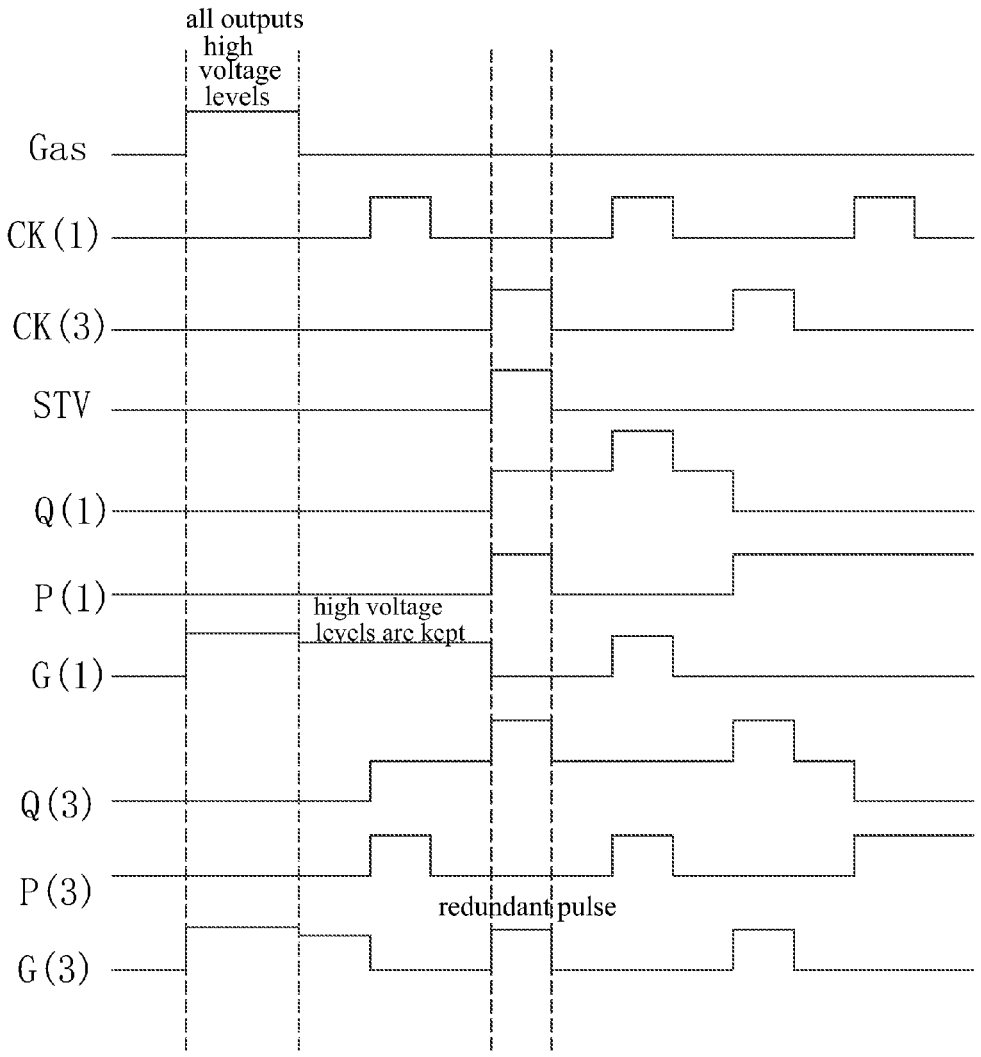
Fig. 2 (Prior Art)
FIG. 2 is a sequence diagram of the GOA circuit shown in FIG. 1.
Figure 3:
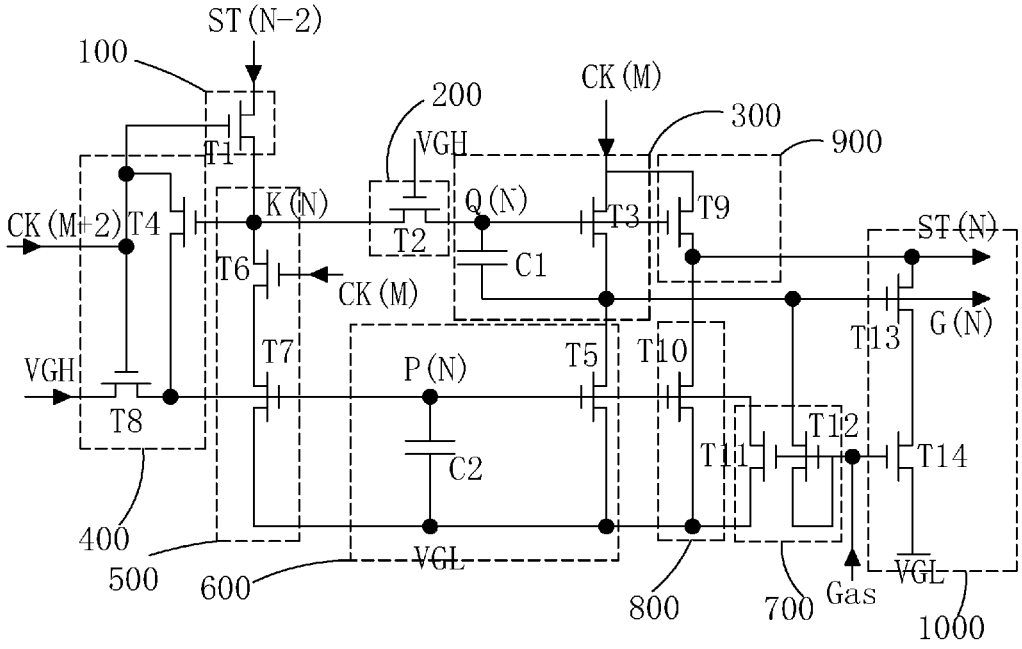
FIG. 3 is a circuit diagram of the first embodiment according to the GOA circuit of the present invention.
Figure 7:
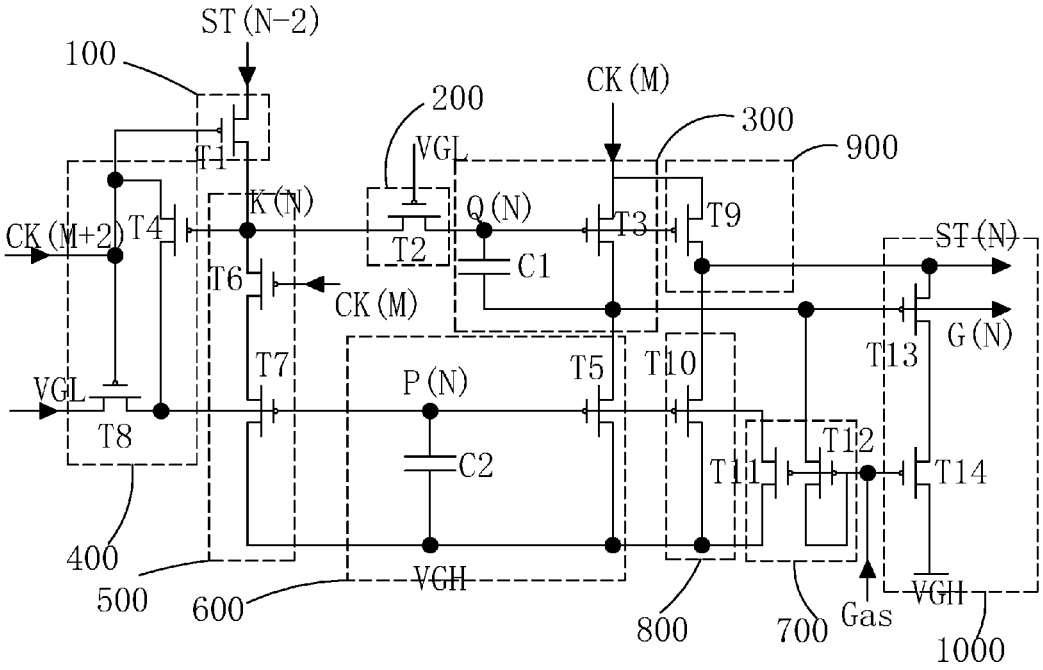
FIG. 7 is a circuit diagram of the second embodiment according to the GOA circuit of the present invention.
Figure 8:
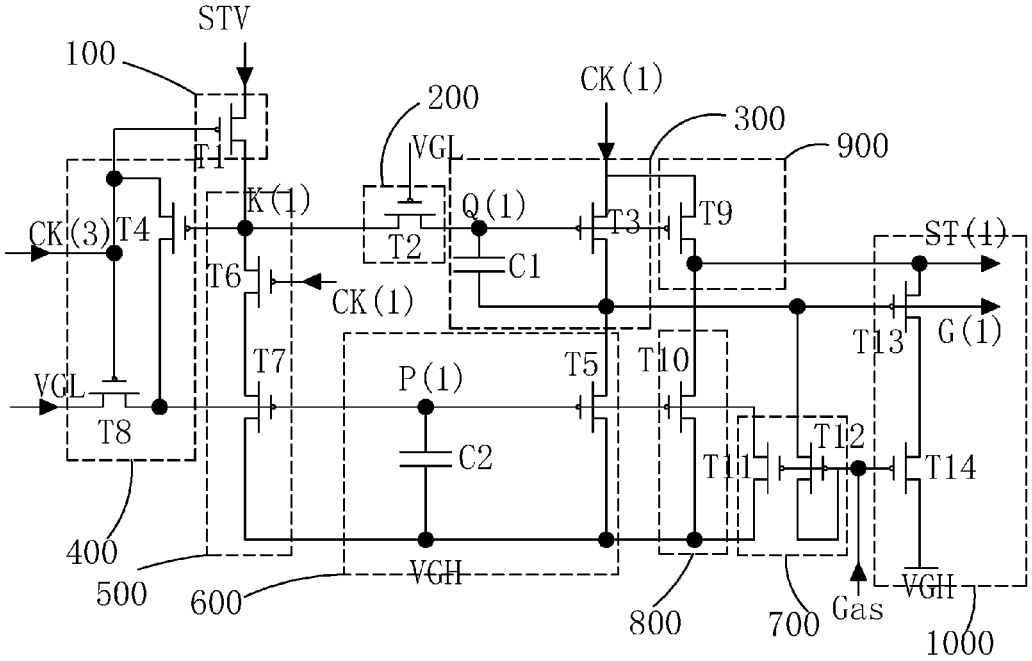
FIG. 8 is a circuit diagram of the first stage GOA unit of the GOA circuit shown in FIG. 7.
Figure 9:
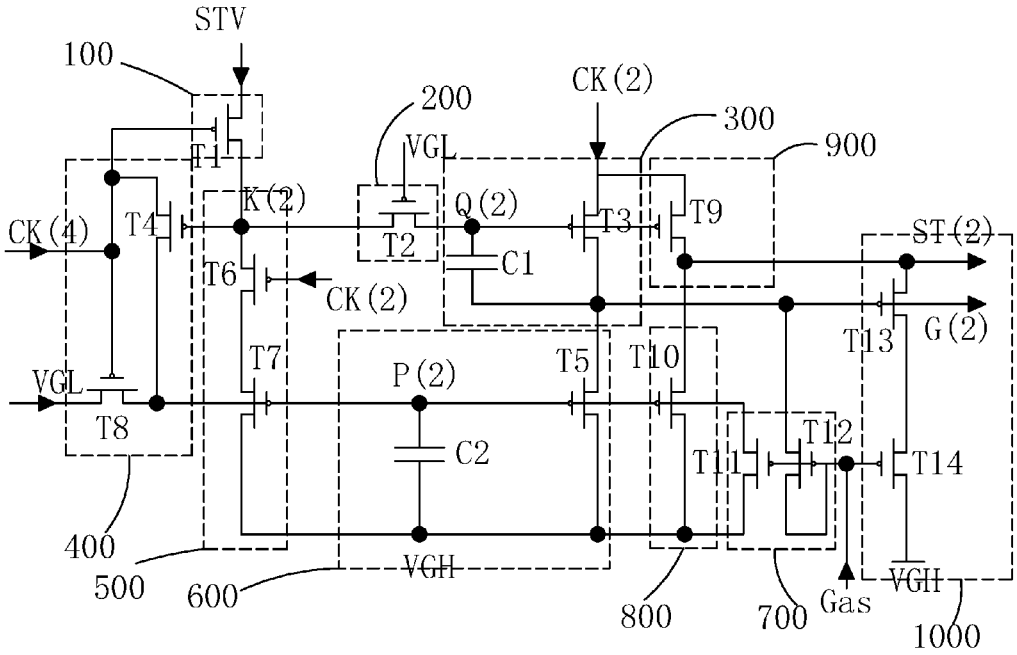
FIG. 9 is a circuit diagram of the second stage GOA unit of the GOA circuit shown in FIG. 7.

Please refer to FIG. 3 or FIG. 7. The present invention first provides a GOA circuit, comprising GOA units of a plurality of stages which are cascade coupled, and the GOA unit of each stage comprises: a control input unit 100, a voltage stabilizing unit 200, an output unit 300, a second node control unit 400, a first node pull-down unit 500, a pull-down holding unit 600, a global control unit 700, a stage transfer pull-down unit 800, a stage transfer unit 900 and a global control auxiliary unit 1000.

N is set to be a positive integer and except the GOA unit of the first and second stages, in the GOA unit of the Nth stage:

the control input unit 100 comprises: a first thin film transistor T1, and a gate of the first thin film transistor T1 is electrically coupled to a M+2th clock signal CK(M+2), and a source is electrically coupled to a stage transfer end ST(N−2) of two former stage n−2th GOA unit, and a drain is electrically coupled to a third node K(N);

the voltage stabilizing unit 200 comprises: a second thin film transistor T2, and a gate of the second thin film transistor T2 is electrically coupled to a first constant voltage level, and a source is electrically coupled to the third node K(N), and a drain is electrically coupled to a first node Q(N);

the output unit 300 comprises: a third thin film transistor T3, and a gate of the third thin film transistor T3 is electrically coupled to the first node Q(n), and a source is electrically coupled to a Mth clock signal CK(M), and a drain is electrically coupled to an output end G(n); and a first capacitor C1, and one end of the first capacitor C1 is electrically coupled to a first node Q(n), and the other end is electrically coupled to the output end G(n);

the second node control unit 400 comprises: a fourth thin film transistor T4, and a gate of the fourth thin film transistor T4 is electrically coupled to the third node K(N), and a source is electrically coupled to the M+2th clock signal CK(M+2), and a drain is electrically coupled to the second node P(N); and an eighth thin film transistor T8, and a gate of the eighth thin film transistor T8 is electrically coupled to the M+2th clock signal CK(M+2), and a source is electrically coupled to the first constant voltage level, and a drain is electrically coupled to the second node P(N);

the first node pull-down unit 500 comprises: a sixth thin film transistor T6, and a gate of the sixth thin film transistor T6 is electrically coupled to the Mth clock signal CK(M), and a source is electrically coupled to a drain of a seventh thin film transistor T7, and a drain is electrically coupled to the third node K(N); and the seventh thin film transistor T7, and a gate of the seventh thin film transistor T7 is electrically coupled to the second node P(N), and a source is electrically coupled to a second constant voltage level;

the pull-down holding unit 600 comprises: a fifth thin film transistor T5, and a gate of the fifth thin film transistor T5 is electrically coupled to the second node P(N), and a source is electrically coupled to the second constant voltage level, and a drain is electrically coupled to the output end G(N); and a second capacitor C2, and one end of the second capacitor C2 is electrically coupled to the second node P(N), and the other end is electrically coupled to the second constant voltage level;

the global control unit 700 comprises: an eleventh thin film transistor T11, and a gate of the eleventh thin film transistor T11 is electrically coupled to a global control signal Gas, and a source is electrically coupled to the second constant voltage level, and a drain is electrically coupled to the second node P(N); and a twelfth thin film transistor T12, and both a gate and a source of the twelfth thin film transistor T12 are electrically coupled to the global control signal Gas, and a drain is electrically coupled to the output end G(N);

the stage transfer pull-down unit 800 comprises: a tenth thin film transistor T10, and a gate of the tenth thin film transistor T10 is electrically coupled to the second node P(N), and a source is electrically coupled to the second constant voltage level, and a drain is electrically coupled to the stage transfer end ST(N);

the stage transfer 900 comprises: a ninth thin film transistor T9, and a gate of the ninth thin film transistor T9 is electrically coupled to the first node Q(N), and a source is electrically coupled to the Mth clock signal CK(M), and a drain is electrically coupled to the stage transfer end ST(N);

the global control auxiliary unit 1000 comprises: a thirteenth thin film transistor T13, and a gate of the thirteenth thin film transistor T13 is electrically coupled to the output end G(N), and a source is electrically coupled to a drain of a fourteenth thin film transistor T14, and a drain is electrically coupled to the stage transfer end ST(N); and the fourteenth thin film transistor T14, and a gate of the fourteenth thin film transistor T14 is electrically coupled to the global control signal Gas, and a source is electrically coupled to the second constant voltage level.

Figure 4:
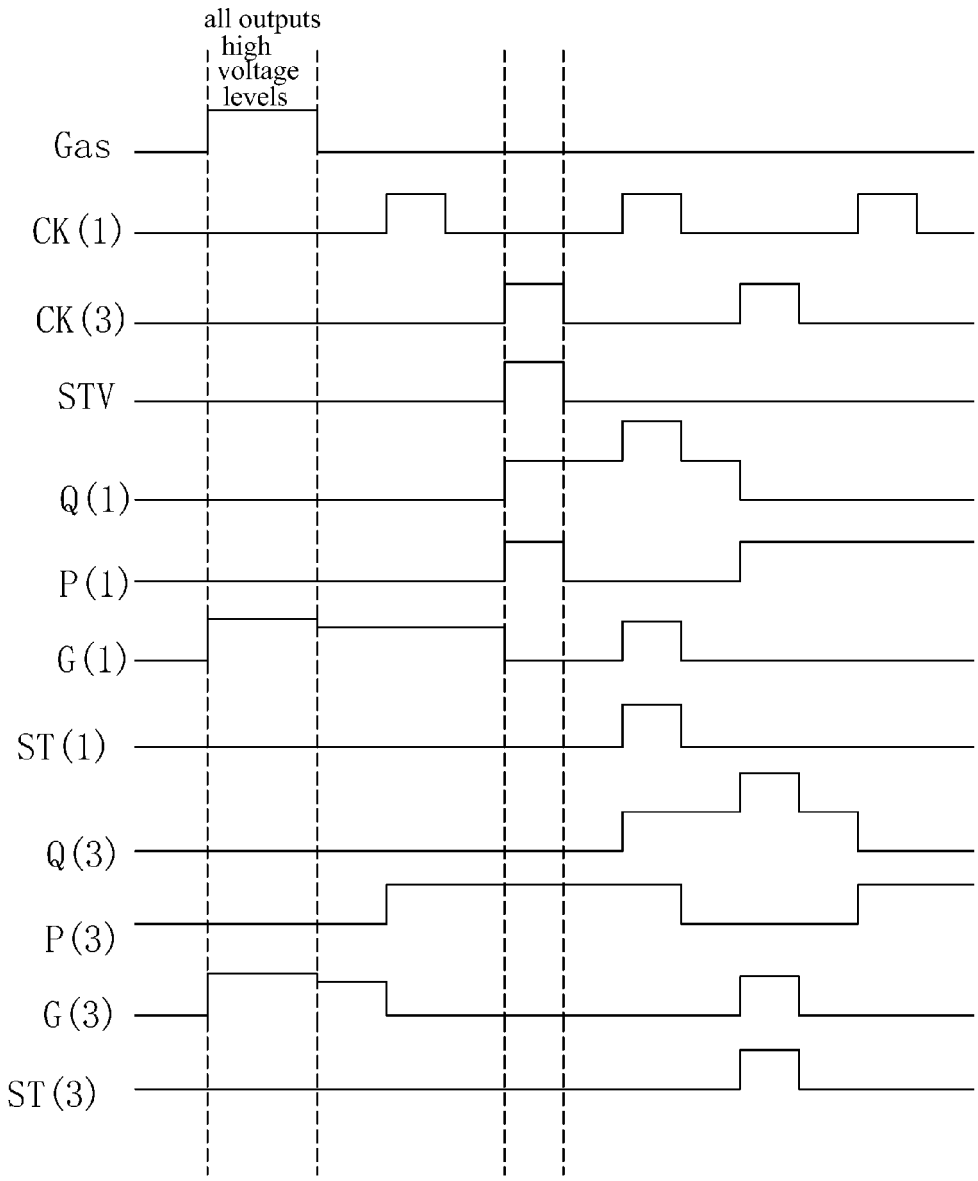
FIG. 4 is a sequence diagram of the GOA circuit shown in FIG. 3.
Figure 5:
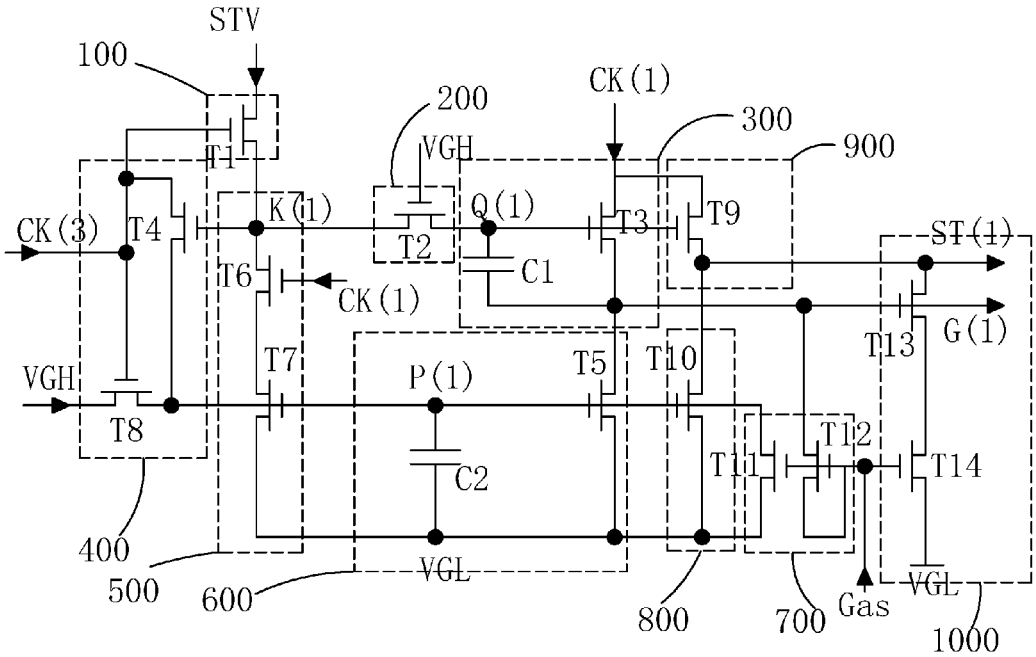
FIG. 5 is a circuit diagram of the first stage GOA unit of the GOA circuit shown in FIG. 3.
Figure 6:
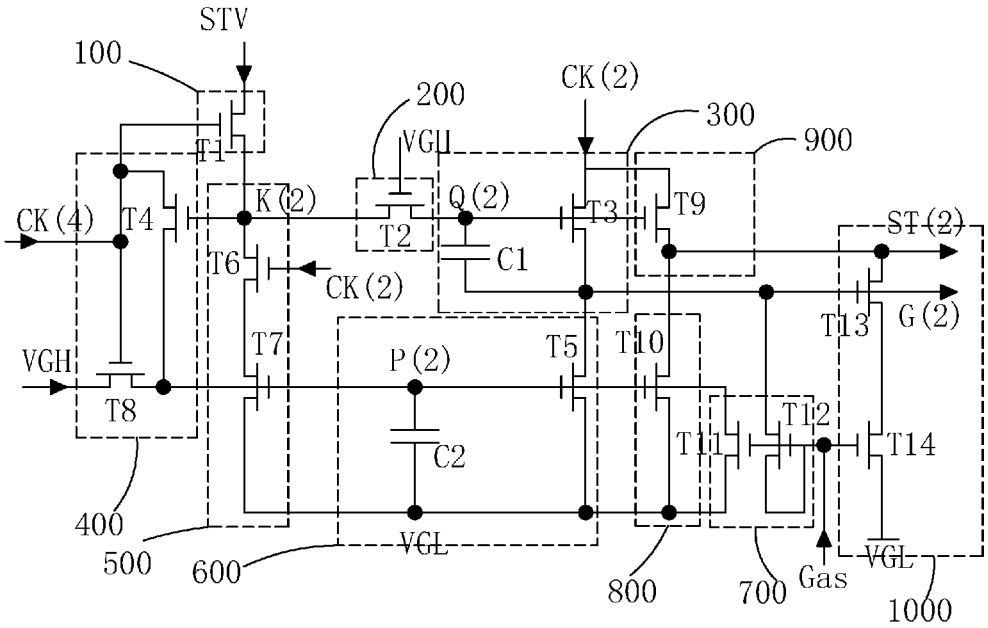
FIG. 6 is a circuit diagram of the second stage GOA unit of the GOA circuit shown in FIG. 3.

Selectably, referring to FIG. 3 with combination of FIG. 4, in the first embodiment of the present invention, the respective thin film transistors are all N-type LTPS semiconductor thin film transistors, and the first constant voltage level is a constant high voltage level VGH, and the second constant voltage level is a constant low voltage level VGL; as the global control signal Gas provides high voltage level, the output ends of all the GOA units output high voltage levels at the same time, and meanwhile, the stage transfer ends of all the GOA units output low voltage levels at the same time. The first embodiment of the present invention comprises four clock signals providing high voltage level pulses: a first, a second, a third and a fourth clock signals CK(1), CK(2), CK(3), CK(4); as the Mth clock signal CK(M) is the third clock signal CK(3), the M+2th clock signal CK(M+2) is the first clock signal CK(1); as the Mth clock signal CK(M) is the fourth clock signal CK(4), the M+2th clock signal CK(M+2) is the second clock signal CK(2). The pulse periods of the first, the second, the third and the fourth clock signals CK(1), CK(2), CK(3), CK(4) are the same, and a first pulse signal of the first clock signal CK(1) is first generated, and a first pulse signal of the second clock signal CK(2) is generated at the same time while the first pulse signal of the first clock signal CK(1) is finished, and a first pulse signal of the third clock signal CK(3) is generated at the same time while the first pulse signal of the second clock signal CK(2) is finished, and a first pulse signal of the fourth clock signal CK(4) is generated at the same time while the first pulse signal of the third clock signal CK(3) is finished, and a second pulse signal of the first clock signal CK(1) is generated at the same time while the first pulse signal of the fourth clock signal CK(4) is finished.

Selectably, referring to FIG. 7, in the second embodiment of the present invention, the respective thin film transistors are all P-type LTPS semiconductor thin film transistors, and the first constant voltage level is a constant low voltage level VGL, and the second constant voltage level is a constant high voltage level VGH; as the global control signal Gas provides low voltage level, the output ends of all the GOA units output low voltage levels at the same time, and meanwhile, the stage transfer ends of all the GOA units output high voltage levels at the same time. The first embodiment of the present invention comprises four clock signals providing low voltage level pulses: a first, a second, a third and a fourth clock signals CK(1), CK(2), CK(3), CK(4); as the Mth clock signal CK(M) is the third clock signal CK(3), the M+2th clock signal CK(M+2) is the first clock signal CK(1); as the Mth clock signal CK(M) is the fourth clock signal CK(4), the M+2th clock signal CK(M+2) is the second clock signal CK(2). The pulse periods of the first, the second, the third and the fourth clock signals CK(1), CK(2), CK(3), CK(4) are the same, and a first pulse signal of the first clock signal CK(1) is first generated, and a first pulse signal of the second clock signal CK(2) is generated at the same time while the first pulse signal of the first clock signal CK(1) is finished, and a first pulse signal of the third clock signal CK(3) is generated at the same time while the first pulse signal of the second clock signal CK(2) is finished, and a first pulse signal of the fourth clock signal CK(4) is generated at the same time while the first pulse signal of the third clock signal CK(3) is finished, and a second pulse signal of the first clock signal CK(1) is generated at the same time while the first pulse signal of the fourth clock signal CK(4) is finished.

Particularly, referring to FIG. 5 and FIG. 6 or FIG. 8 and FIG. 9, in the first stage GOA unit of the GOA circuit of the present invention, the source of the first thin film transistor T1 is electrically coupled to the start signal STV of the circuit, and the gate of the first thin film transistor T1 is electrically coupled to the third clock signal CK(3), and the source of the third thin film transistor T3 is electrically coupled to the first clock signal CK(1); in the second stage GOA unit, the source of the first thin film transistor T1 is electrically coupled to the start signal STV of the circuit, and the gate of the first thin film transistor T1 is electrically coupled to the fourth clock signal CK(4), and the source of the third thin film transistor T3 is electrically coupled to the second clock signal CK(2).

Specifically, referring to FIG. 3 with combination of FIG. 4, the GOA circuit of the present invention utilizes the interlaced scan. The stage transfer signal generated by the first stage GOA unit is transmitted to the third stage GOA unit, and the stage transfer signal generated by the second stage GOA unit is transmitted to the fourth stage GOA unit, and the stage transfer signal generated by the third stage GOA unit is transmitted to the fifth stage GOA unit, and the stage transfer signal generated by the fourth stage GOA unit is transmitted to the sixth stage GOA unit, and so on. The first embodiment of the present invention is illustrated below for explaining the working procedure of the GOA circuit of the present invention:

First, the global control signal Gas provides high voltage level, and the eleventh, the twelfth and the fourteenth thin film transistors T11, T12, T14 of all the GOA units are all activated, and the twelfth thin film transistor T12 in all the GOA units make the scan driving signal outputted by the output end G(N) be the high voltage level provided by the global control signal Gas, and the eleventh thin film transistor T11 pulls down the second node P(N) to the constant low voltage level VGL, and meanwhile, the thirteenth thin film transistor T13 controlled by the output end G(N) is activated, and pulls down the stage transfer end ST(N) to the constant low voltage level VGL with the fourteenth thin film transistor T14 together, and the stage transfer signals outputted by the stage transfer ends ST(N) of the GOA units of the respective stages are all low voltage levels.

Then, the global control signal Gas provides low voltage level, and the output ends G(N) of all the GOA units are acted by the first capacitors C1 to be kept at high voltage level, and the stage transfer ends ST(N) remain to be low voltage level;

and then, the first clock signal CK(1) provides high voltage level, and the stage transfer end ST(1) of the first stage GOA unit is kept to be low voltage level, and in the third stage GOA unit: the first thin film transistor T1 and the eighth thin film transistor T8 are activated, and the first node Q(3) is low voltage level, and the second node P(3) is charged to be high voltage level, and the fifth thin film transistor T5 is activated, and the third thin film transistor T3 is deactivated, and the output end G(3) is discharged to be the constant low voltage level VGL;

and then, the third clock signal CK(3) and the start signal STV of the circuit provide high voltage levels, and in the first stage GOA unit: the first thin film transistor T1 is activated, and the first node Q(1) of the first stage GOA unit is charged to be high voltage level, and the eighth thin film transistor T8 is activated, and the second node P(1) is charged to be high voltage level, and the fifth thin film transistor T5 is activated to pull down the output end G(1) to the constant low voltage level VGL; in the third stage GOA unit: the first node Q(3) is kept to be low voltage level, and the third thin film transistor T3 is deactivated, and the output end G(3) is kept to be low voltage level without generating the redundant pulses;

after that, the third clock signal CK(3) and the start signal STV of the circuit provide low voltage levels, and the first thin film transistor T1 in the first stage GOA unit is deactivated, and the fourth thin film transistor T4 is controlled by the third node K(1) (the voltage level is the same as the first node Q(1)) to be activated to pull down the second node P(1) to be low voltage level;

and then, the first clock signal CK(1) provides high voltage level again, and in the first stage GOA unit: the third, the ninth thin film transistors T3, T9 are controlled by the first node Q(1) to be activated, and both the stage transfer end ST(1) and the output end G(1) output the high voltage level provided by the first clock signal CK(1) to be high voltage levels of the stage transfer signal and the scan driving signal, and the first node Q(1) is acted by the first capacitor C1 to be raised to be higher voltage level; in the third stage GOA unit: the first thin film transistor T1 is activated, and the first node Q(3) is kept to be charged to be high voltage level, and the second node P(3) is kept to be high voltage level, and the output end G(3) is kept to be low voltage level;

finally, the third clock signal CK(3) provides high voltage level again, and in the first stage GOA unit: the first and the eighth thin film transistors T1, T8 are activated, and the second node P(1) is charged to be high voltage level, and the first node Q(1) is dropped to be low voltage level, and the fifth and the tenth thin film transistors T5, T10 controlled by the second node are activated to respectively pull down the voltage levels of the output end G(1) and the stage transfer end ST(1) to be the constant low voltage level VGL to be the low voltage levels of the scan driving signal and the stage transfer signal; in the third stage GOA unit: the third and the ninth thin film transistors T3, T9 are controlled by the first node Q(3) to be activated, and the stage transfer end ST(3) and the output end G(3) output the high voltage level provided by the third clock signal CK(3) to be high voltage levels of the stage transfer signal and the scan driving signal, and the first node Q(3) is acted by the first capacitor C1 to be raised to be higher voltage level, and so on.

The aforesaid GOA circuit does not generate redundant pulses in the entire working procedure, and the GOA circuit normally performs the scan driving to promote the working stability of the liquid crystal display device.

The second embodiment shown in FIG. 7 is similar with the specific working procedure of the aforesaid first embodiment. Only the high and low of the respective signals and nodes need to be changed. No detail description is repeated here.

The present invention further provides a liquid crystal display device comprising the aforesaid GOA circuit, and thus possesses well working stability.

In conclusion, in the GOA circuit of the present invention, by adding the stage transfer unit and the stage transfer pull-down unit and modifying the global control auxiliary unit to use the stage transfer end of the stage transfer unit to output the signal which is different from the scan driving signal to be the stage transfer signal and to use the global control auxiliary unit to stable the voltage level of the stage transfer end in the period that the output ends of all the GOA units output the scan driving signal at the same time, the signal outputted by the stage transfer end is opposite to the voltage level of the scan driving signal. After accomplishing global controlling the output ends of all the GOA units to output at the same time, the circuit failure issue due to that the scan driving signal outputted by the GOA unit is employed to be the stage transfer signal in prior art can be avoided to eliminate the redundant pulse in the GOA circuit stage transferring procedure for ensuring the normal work of the GOA circuit and promoting the working stability of the liquid crystal display device. The liquid crystal display device of the present invention comprises the aforesaid GOA circuit, and possesses well working stability.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A Gate Driver on Array (GOA) circuit, comprising GOA units of a plurality of stages which are cascade coupled, and the GOA unit of each stage comprises: a control input unit, a voltage stabilizing unit, an output unit, a second node control unit, a first node pull-down unit, a pull-down holding unit, a global control unit, a stage transfer pull-down unit, a stage transfer unit and a global control auxiliary unit;

N is set to be a positive integer and except the GOA unit of the first and second stages, in the GOA unit of the Nth stage:

the control input unit comprises: a first thin film transistor, and a gate of the first thin film transistor is electrically coupled to a M+2th clock signal, and a source is electrically coupled to a stage transfer end of two former stage n−2th GOA unit, and a drain is electrically coupled to a third node;

the voltage stabilizing unit comprises: a second thin film transistor, and a gate of the second thin film transistor is electrically coupled to a first constant voltage level, and a source is electrically coupled to the third node, and a drain is electrically coupled to a first node;

the output unit comprises: a third thin film transistor, and a gate of the third thin film transistor is electrically coupled to the first node, and a source is electrically coupled to a Mth clock signal, and a drain is electrically coupled to an output end; and a first capacitor, and one end of the first capacitor is electrically coupled to the first node, and the other end is electrically coupled to the output end;

the second node control unit comprises: a fourth thin film transistor, and a gate of the fourth thin film transistor is electrically coupled to the third node, and a source is electrically coupled to the M+2th clock signal, and a drain is electrically coupled to the second node; and an eighth thin film transistor, and a gate of the eighth thin film transistor is electrically coupled to the M+2th clock signal, and a source is electrically coupled to the first constant voltage level, and a drain is electrically coupled to the second node;

the first node pull-down unit comprises: a sixth thin film transistor, and a gate of the sixth thin film transistor is electrically coupled to the Mth clock signal, and a source is electrically coupled to a drain of a seventh thin film transistor, and a drain is electrically coupled to the third node; and the seventh thin film transistor, and a gate of the seventh thin film transistor is electrically coupled to the second node, and a source is electrically coupled to a second constant voltage level;

the pull-down holding unit comprises: a fifth thin film transistor, and a gate of the fifth thin film transistor is electrically coupled to the second node, and a source is electrically coupled to the second constant voltage level, and a drain is electrically coupled to the output end; and a second capacitor, and one end of the second capacitor is electrically coupled to the second node, and the other end is electrically coupled to the second constant voltage level;

the global control unit comprises: an eleventh thin film transistor, and a gate of the eleventh thin film transistor is electrically coupled to a global control signal, and a source is electrically coupled to the second constant voltage level, and a drain is electrically coupled to the second node; and a twelfth thin film transistor, and both a gate and a source of the twelfth thin film transistor are electrically coupled to the global control signal, and a drain is electrically coupled to the output end;

the stage transfer pull-down unit comprises: a tenth thin film transistor, and a gate of the tenth thin film transistor is electrically coupled to the second node, and a source is electrically coupled to the second constant voltage level, and a drain is electrically coupled to the stage transfer end;

the stage transfer comprises: a ninth thin film transistor, and a gate of the ninth thin film transistor is electrically coupled to the first node, and a source is electrically coupled to the Mth clock signal, and a drain is electrically coupled to the stage transfer end;

the global control auxiliary unit comprises: a thirteenth thin film transistor, and a gate of the thirteenth thin film transistor is electrically coupled to the output end, and a source is electrically coupled to a drain of a fourteenth thin film transistor, and a drain is electrically coupled to the stage transfer end; and the fourteenth thin film transistor, and a gate of the fourteenth thin film transistor is electrically coupled to the global control signal, and a source is electrically coupled to the second constant voltage level.

2. The GOA circuit according to claim 1, wherein the respective thin film transistors are all N-type LTPS semiconductor thin film transistors, and the first constant voltage level is a constant high voltage level, and the second constant voltage level is a constant low voltage level.

3. The GOA circuit according to claim 2, wherein as the global control signal provides high voltage level, the output ends of all the GOA units output high voltage levels at the same time, and meanwhile, the stage transfer ends of all the GOA units output low voltage levels at the same time.

4. The GOA circuit according to claim 1, wherein the respective thin film transistors are all P-type LTPS semiconductor thin film transistors, and the first constant voltage level is a constant low voltage level, and the second constant voltage level is a constant high voltage level.

5. The GOA circuit according to claim 4, wherein as the global control signal provides low voltage level, the output ends of all the GOA units output low voltage levels at the same time, and meanwhile, the stage transfer ends of all the GOA units output high voltage levels at the same time.

6. The GOA circuit according to claim 1, wherein in the first stage GOA unit and the second stage GOA unit, the source of the first thin film transistor is electrically coupled to a start signal of the circuit.

7. The GOA circuit according to claim 1, comprising four clock signals: a first, a second, a third and a fourth clock signals; as the Mth clock signal is the third clock signal, the M+2th clock signal is the first clock signal; as the Mth clock signal is the fourth clock signal, the M+2th clock signal is the second clock signal.

8. The GOA circuit according to claim 7, wherein the pulse periods of the first, the second, the third and the fourth clock signals are the same, and a first pulse signal of the first clock signal is first generated, and a first pulse signal of the second clock signal is generated at the same time while the first pulse signal of the first clock signal is finished, and a first pulse signal of the third clock signal is generated at the same time while the first pulse signal of the second clock signal is finished, and a first pulse signal of the fourth clock signal is generated at the same time while the first pulse signal of the third clock signal is finished, and a second pulse signal of the first clock signal is generated at the same time while the first pulse signal of the fourth clock signal is finished.

9. A liquid crystal display device, comprising a Gate Driver on Array (GOA) circuit, and the GOA unit comprises GOA units of a plurality of stages which are cascade coupled, and the GOA unit of each stage comprises: a control input unit, a voltage stabilizing unit, an output unit, a second node control unit, a first node pull-down unit, a pull-down holding unit, a global control unit, a stage transfer pull-down unit, a stage transfer unit and a global control auxiliary unit;

N is set to be a positive integer and except the GOA unit of the first and second stages, in the GOA unit of the Nth stage:

the control input unit comprises: a first thin film transistor, and a gate of the first thin film transistor is electrically coupled to a M+2th clock signal, and a source is electrically coupled to a stage transfer end of two former stage n−2th GOA unit, and a drain is electrically coupled to a third node;

the voltage stabilizing unit comprises: a second thin film transistor, and a gate of the second thin film transistor is electrically coupled to a first constant voltage level, and a source is electrically coupled to the third node, and a drain is electrically coupled to a first node;

the output unit comprises: a third thin film transistor, and a gate of the third thin film transistor is electrically coupled to the first node, and a source is electrically coupled to a Mth clock signal, and a drain is electrically coupled to an output end; and a first capacitor, and one end of the first capacitor is electrically coupled to the first node, and the other end is electrically coupled to the output end;

the second node control unit comprises: a fourth thin film transistor, and a gate of the fourth thin film transistor is electrically coupled to the third node, and a source is electrically coupled to the M+2th clock signal, and a drain is electrically coupled to the second node; and an eighth thin film transistor, and a gate of the eighth thin film transistor is electrically coupled to the M+2th clock signal, and a source is electrically coupled to the first constant voltage level, and a drain is electrically coupled to the second node;

the first node pull-down unit comprises: a sixth thin film transistor, and a gate of the sixth thin film transistor is electrically coupled to the Mth clock signal, and a source is electrically coupled to a drain of a seventh thin film transistor, and a drain is electrically coupled to the third node; and the seventh thin film transistor, and a gate of the seventh thin film transistor is electrically coupled to the second node, and a source is electrically coupled to a second constant voltage level;

the pull-down holding unit comprises: a fifth thin film transistor, and a gate of the fifth thin film transistor is electrically coupled to the second node, and a source is electrically coupled to the second constant voltage level, and a drain is electrically coupled to the output end; and a second capacitor, and one end of the second capacitor is electrically coupled to the second node, and the other end is electrically coupled to the second constant voltage level;

the global control unit comprises: an eleventh thin film transistor, and a gate of the eleventh thin film transistor is electrically coupled to a global control signal, and a source is electrically coupled to the second constant voltage level, and a drain is electrically coupled to the second node; and a twelfth thin film transistor, and both a gate and a source of the twelfth thin film transistor are electrically coupled to the global control signal, and a drain is electrically coupled to the output end;

the stage transfer pull-down unit comprises: a tenth thin film transistor, and a gate of the tenth thin film transistor is electrically coupled to the second node, and a source is electrically coupled to the second constant voltage level, and a drain is electrically coupled to the stage transfer end;

the stage transfer comprises: a ninth thin film transistor, and a gate of the ninth thin film transistor is electrically coupled to the first node, and a source is electrically coupled to the Mth clock signal, and a drain is electrically coupled to the stage transfer end;

the global control auxiliary unit comprises: a thirteenth thin film transistor, and a gate of the thirteenth thin film transistor is electrically coupled to the output end, and a source is electrically coupled to a drain of a fourteenth thin film transistor, and a drain is electrically coupled to the stage transfer end; and the fourteenth thin film transistor, and a gate of the fourteenth thin film transistor is electrically coupled to the global control signal, and a source is electrically coupled to the second constant voltage level.

10. The liquid crystal display device according to claim 9, wherein the respective thin film transistors are all N-type LTPS semiconductor thin film transistors, and the first constant voltage level is a constant high voltage level, and the second constant voltage level is a constant low voltage level.

11. The liquid crystal display device according to claim 10, wherein as the global control signal provides high voltage level, the output ends of all the GOA units output high voltage levels at the same time, and meanwhile, the stage transfer ends of all the GOA units output low voltage levels at the same time.

12. The liquid crystal display device according to claim 9, wherein the respective thin film transistors are all P-type LTPS semiconductor thin film transistors, and the first constant voltage level is a constant low voltage level, and the second constant voltage level is a constant high voltage level.

13. The liquid crystal display device according to claim 12, wherein as the global control signal provides low voltage level, the output ends of all the GOA units output low voltage levels at the same time, and meanwhile, the stage transfer ends of all the GOA units output high voltage levels at the same time.

14. The liquid crystal display device according to claim 9, wherein in the first stage GOA unit and the second stage GOA unit, the source of the first thin film transistor is electrically coupled to a start signal of the circuit.

15. The liquid crystal display device according to claim 9, comprising four clock signals: a first, a second, a third and a fourth clock signals; as the Mth clock signal is the third clock signal, the M+2th clock signal is the first clock signal; as the Mth clock signal is the fourth clock signal, the M+2th clock signal is the second clock signal.

16. The liquid crystal display device according to claim 15, wherein the pulse periods of the first, the second, the third and the fourth clock signals are the same, and a first pulse signal of the first clock signal is first generated, and a first pulse signal of the second clock signal is generated at the same time while the first pulse signal of the first clock signal is finished, and a first pulse signal of the third clock signal is generated at the same time while the first pulse signal of the second clock signal is finished, and a first pulse signal of the fourth clock signal is generated at the same time while the first pulse signal of the third clock signal is finished, and a second pulse signal of the first clock signal is generated at the same time while the first pulse signal of the fourth clock signal is finished.

* * * * *